US009554599B2

(12) United States Patent
Balland

(10) Patent No.: US 9,554,599 B2
(45) Date of Patent: Jan. 31, 2017

(54) BRASSIERE WITH ADJUSTABLE SPACING BETWEEN CUPS

(71) Applicant: Tiasha A. Balland, Cheyenne, WY (US)

(72) Inventor: Tiasha A. Balland, Cheyenne, WY (US)

( * ) Notice: Subject to any disclaimer, the term of this patent is extended or adjusted under 35 U.S.C. 154(b) by 235 days.

(21) Appl. No.: 14/244,814

(22) Filed: Apr. 3, 2014

(65) Prior Publication Data

US 2014/0357159 A1 Dec. 4, 2014

Related U.S. Application Data

(60) Provisional application No. 61/830,009, filed on May 31, 2013.

(51) Int. Cl.

| | |
|---|---|
| ***A41C 3/00*** | (2006.01) |
| *A41D 15/00* | (2006.01) |
| *A41C 3/12* | (2006.01) |

(52) U.S. Cl.

CPC ..... *A41C 3/0028* (2013.01); *A41C 3/124* (2013.01); *A41D 15/00* (2013.01)

(58) Field of Classification Search

CPC ..... A41C 1/00; A41C 3/00; A41C 3/02; A41C 3/0028; A41C 3/0061; A41C 3/0021; A41D 7/00

USPC ..... 450/59–61, 62, 63, 67, 68, 69, 71, 73, 78,450/79, 72

See application file for complete search history.

(56) References Cited

U.S. PATENT DOCUMENTS

| | | | | | |
|---|---|---|---|---|---|
| 1,354,467 | A | * | 10/1920 | Clark | A41C 3/02 450/3 |
| 1,655,224 | A | * | 1/1928 | Hirsch | A41C 3/00 450/71 |
| 2,092,390 | A | * | 9/1937 | Federico | A41C 3/0021 450/60 |
| 2,313,811 | A | * | 3/1943 | Dubner | A41C 3/0028 450/68 |
| 2,407,574 | A | * | 9/1946 | Panes | A41C 3/0021 450/68 |
| 2,963,023 | A | * | 12/1960 | Clover | A41C 3/0028 450/59 |
| 3,196,878 | A | | 7/1965 | Hedu | |
| 3,847,158 | A | * | 11/1974 | Guidoni | A41D 7/00 2/67 |
| 3,939,845 | A | * | 2/1976 | Guidoni | A41D 7/00 2/67 |
| 5,868,601 | A | | 2/1999 | Kelemencky | |

(Continued)

FOREIGN PATENT DOCUMENTS

| | | |
|---|---|---|
| JP | 2000-303213 | 10/2000 |

*Primary Examiner* — Gloria Hale

(57) ABSTRACT

The brassiere with adjustable spacing between cups includes an elastic band adapted for releasable mounting about a user's torso and a pair of shoulder straps secured thereto. A pair of fabric cups are secured to the elastic band for supporting the user's breasts. A lower portion of each cup has a channel defined therein and an open end. Each end of an elongate, flexible support wire or member is slidably disposed within a respective one of the channels. Additionally, a pair of flaps are respectively secured to the pair of fabric cups. Each of the flaps has a free end for selective positioning adjacent a respective open end of each of the channels. The free ends may be secured together such that when the flaps are secured, the support wire allows the spacing between the cups to decrease, thus providing additional inward and upward support for the user's breasts.

13 Claims, 4 Drawing Sheets

(56) References Cited

U.S. PATENT DOCUMENTS

| | | | | |
|---|---|---|---|---|
| 6,390,884 | B1 | 5/2002 | Dragojevic | |
| 7,052,359 | B2 | 5/2006 | Chen et al. | |
| 7,267,599 | B2 * | 9/2007 | Allen | A41C 3/0028 450/67 |
| 7,938,710 | B2 * | 5/2011 | Silverman | A41C 3/0021 450/67 |
| 8,177,602 | B1 | 5/2012 | Kaytes | |
| 8,439,722 | B2 * | 5/2013 | Buriak | A41C 3/0064 450/59 |
| 8,506,350 | B1 * | 8/2013 | Silverman | A41C 3/00 450/67 |
| 8,758,081 | B2 * | 6/2014 | Yuasa | A41C 3/0028 450/31 |
| 2010/0130098 | A1 | 5/2010 | Kammerer | |
| 2010/0210178 | A1 | 8/2010 | Chang | |
| 2011/0201253 | A1 | 8/2011 | Stude | |

* cited by examiner

BRASSIERE WITH ADJUSTABLE SPACING BETWEEN CUPS

CROSS-REFERENCE TO RELATED APPLICATION

This application claims the benefit of U.S. Provisional Patent Application Ser. No. 61/830,009, filed May 31, 2013.

BACKGROUND OF THE INVENTION

1. Field of the Invention

The present invention relates to undergarments, and particularly to a brassiere with adjustable spacing between cups to enhance the user's cleavage.

2. Description of the Related Art

The use of brassieres with an underwire to support a woman's breasts is well known in the art. Recently, attempts have been made to enhance the cleavage and appearance of a woman's breasts by pushing up and pushing in on the individual breasts using "push-up" cups, by adding push-up inserts into the brassiere, or by pulling brassiere cups together via straps or the like, thereby enhancing the perceived size of the breasts, as well as the cleavage formed therebetween.

Breasts may be pulled together laterally for the purposes of enhancing cleavage. However, conventional push-up brassieres do not work well with breast implants, as the implant itself tends not to be pushed either upward or inward by the push-up brassiere. When women have breast implants, the breast implant is typically placed underneath the pectoral muscles. As a result, the breast implants are separated from one another and expose the breastbone. To create cleavage for implanted breasts, the breast implants need additional force to be pushed over the breastbone to create a desirable cleavage effect. Typically, push-up brassieres do not provide this additional force.

Thus, a brassiere with adjustable spacing between cups solving the aforementioned problems is desired.

SUMMARY OF THE INVENTION

The brassiere with adjustable spacing between cups includes an elastic band adapted for releasable mounting about a user's torso and a pair of shoulder straps secured to the elastic band. A pair of fabric cups are secured to the elastic band for supporting the user's breasts. The lower portion of each cup has a channel defined therein. Each of the channels defines an open end. Each end of a support wire is slidably disposed within a respective one of the channels defined in the pair of fabric cups. The support wire is slidably adjustable within the channels so that the spacing between the pair of fabric cups may be selectively adjusted by the user.

Additionally, a pair of flaps are respectively secured to the pair of fabric cups. Each of the flaps has a free end for selective positioning adjacent a respective open end of each of the channels. The free ends may be releasably secured together for providing additional coverage and support to the user's breasts. When the flaps are secured, the support wire allows the spacing between the cups to decrease, thus providing additional inward and upward support force for the user's breasts. When the flaps are opened, the support wire may slide out from the channels, increasing the size of the brassiere.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
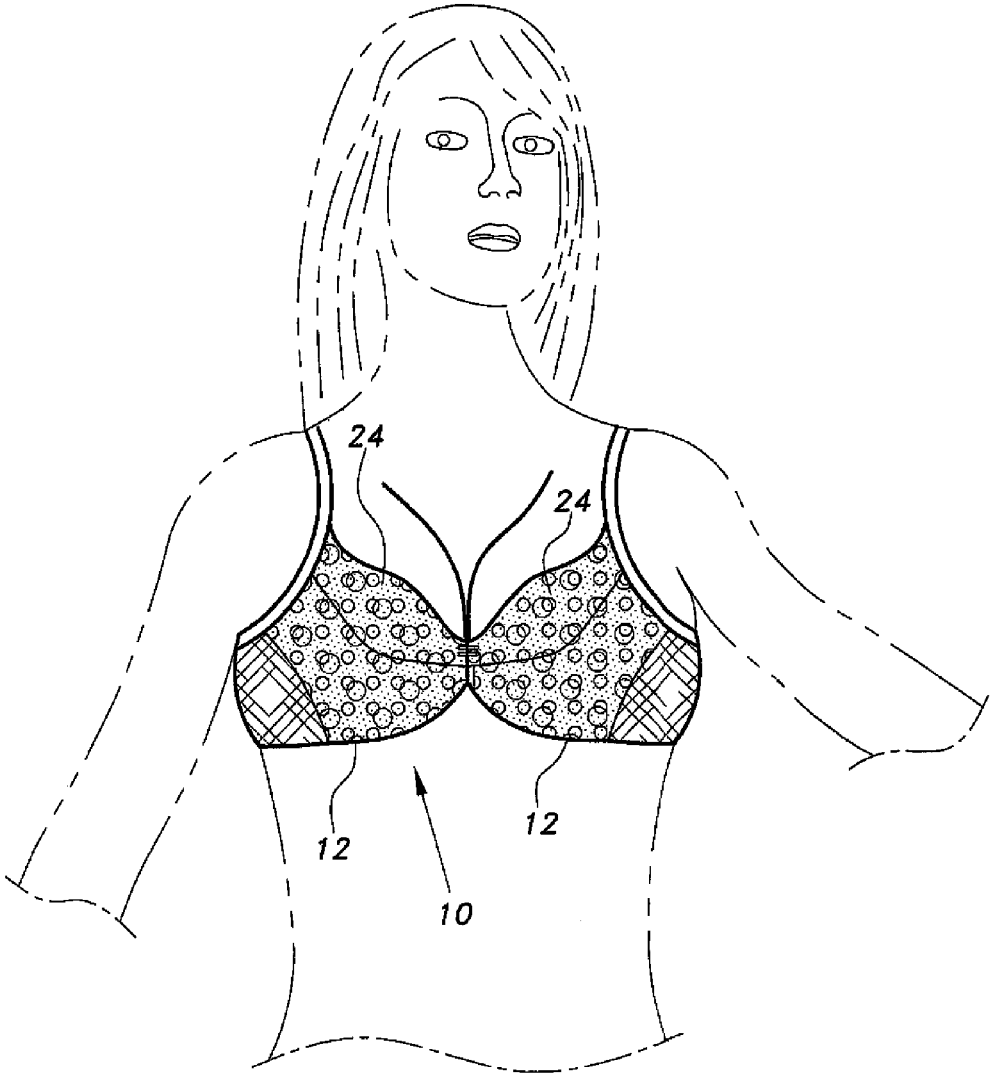
FIG. 1 is an environmental perspective view of a brassiere with adjustable spacing between cups according to the present invention, shown with the cups drawn together for enhanced cleavage.
Figure 2:
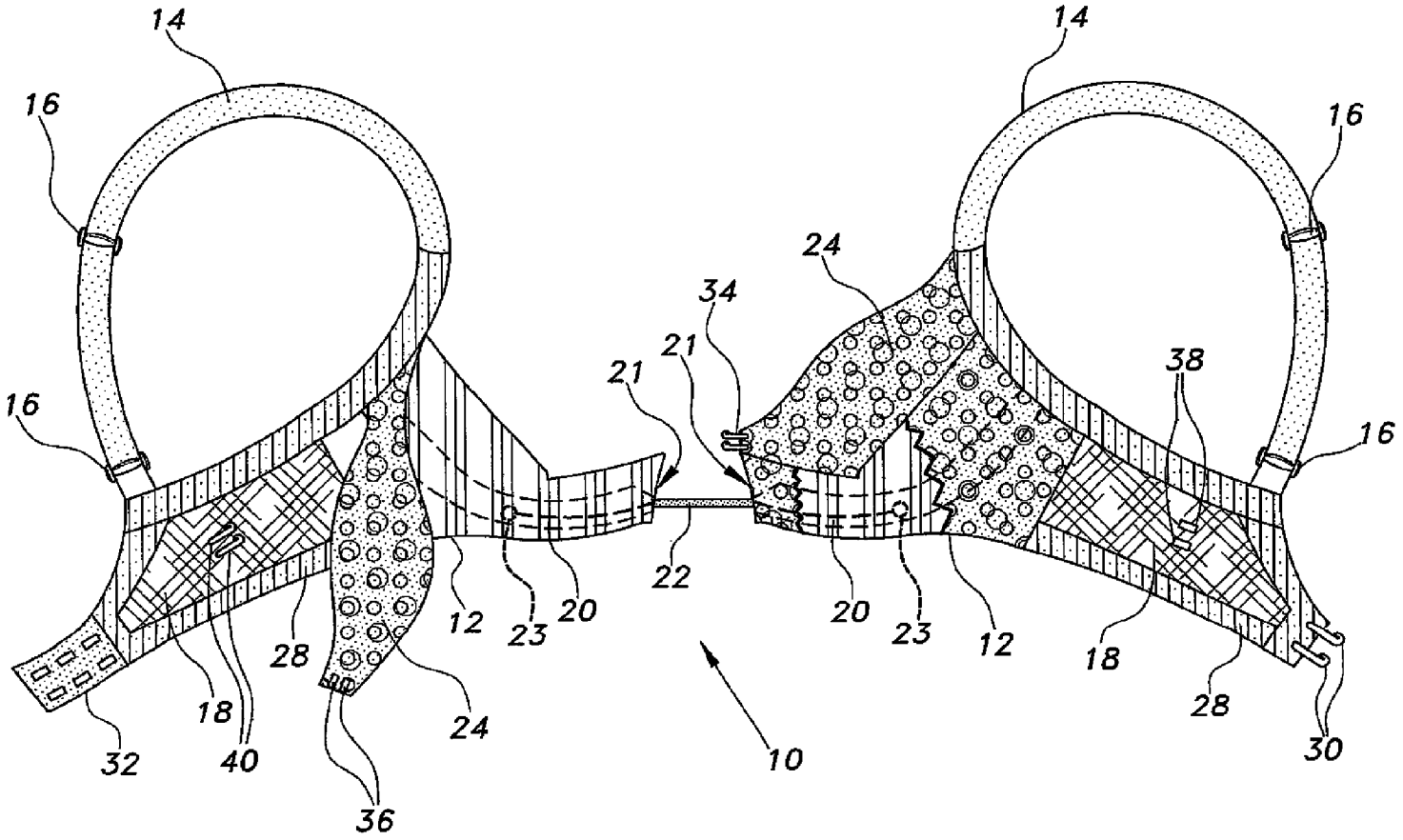
FIG. 2 is a front view of the brassiere with adjustable spacing between cups, illustrating a spaced-apart configuration of the fabric cups, shown with one of the flaps folded forward to show details thereof.

As shown in FIGS. 1 and 2, the brassiere with adjustable spacing between cups 10 is preferably formed as a unitary, integral undergarment, similar to a conventional brassiere. The brassiere with adjustable spacing between cups 10 includes a torso band 28 adapted for encircling the user's upper torso. As is conventionally known in the manufacture of brassieres, the band 28 preferably includes an adjustable fastener, such as conventional closure hooks 30 and closure eyes 32. The brassiere 10 further includes a pair of fabric cups 12 that are supported by two adjustable shoulder straps 14 that are securely attached to the torso band 28. In the Figures, the cups 12 are shown as conventional demi cups, although it should be understood that cups 12 are shown for exemplary purposes only, and that brassiere 10 may include demi cups, open cups or any other desired type of brassiere cups. As is conventionally known, the shoulder straps 14 are adapted for receiving the arms of the user, and may be adjusted to better fit the user's shoulders using buckles 16 or the like.

Figure 4:
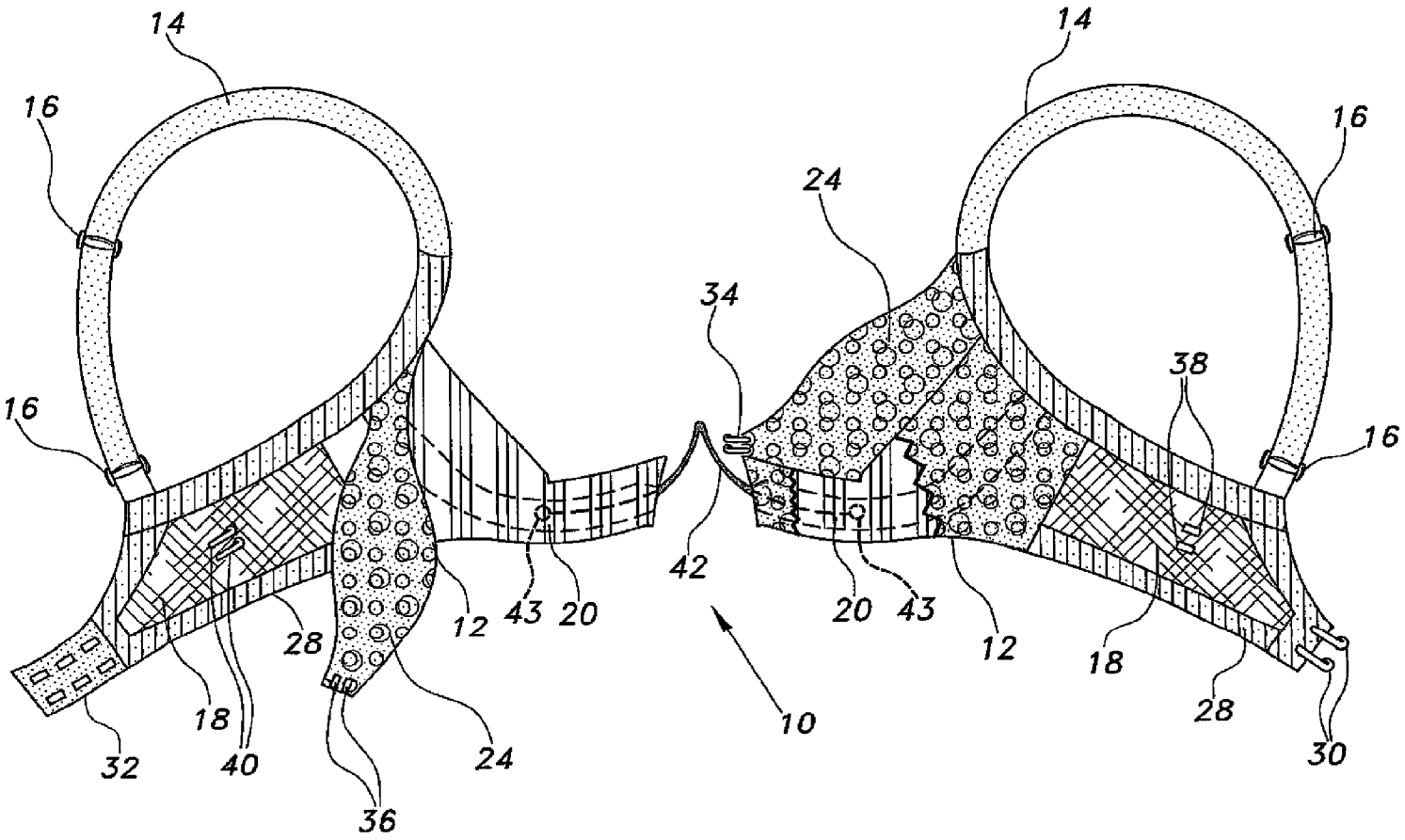
FIG. 4 is a front view of an alternative embodiment of a brassiere with adjustable spacing between cups, illustrating a spaced-apart configuration of the fabric cups.

As best shown in FIG. 2, the lower portion of each cup 12 has a channel 20 defined therein for receiving a support wire 22. Each of the channels 20 defines an open end 21. Each end of the support wire 22 is received within a respective one of the channels 20 defined in the pair of fabric cups 12. In FIG. 2, the support wire 22 is shown as being substantially linear, although it should be understood that the support wire 22 may have any desired configuration. In the alternative embodiment of FIG. 4, the support wire 42 has a substantially pinched or bent central section. It should be understood that support wire 42 is shown for exemplary purposes only, and that support wire 42 may be wider than shown or have a rounded apex for the user's comfort. Similarly, the wire 42 may be covered with fabric or the like for both comfort and aesthetic reasons.

Figure 3:
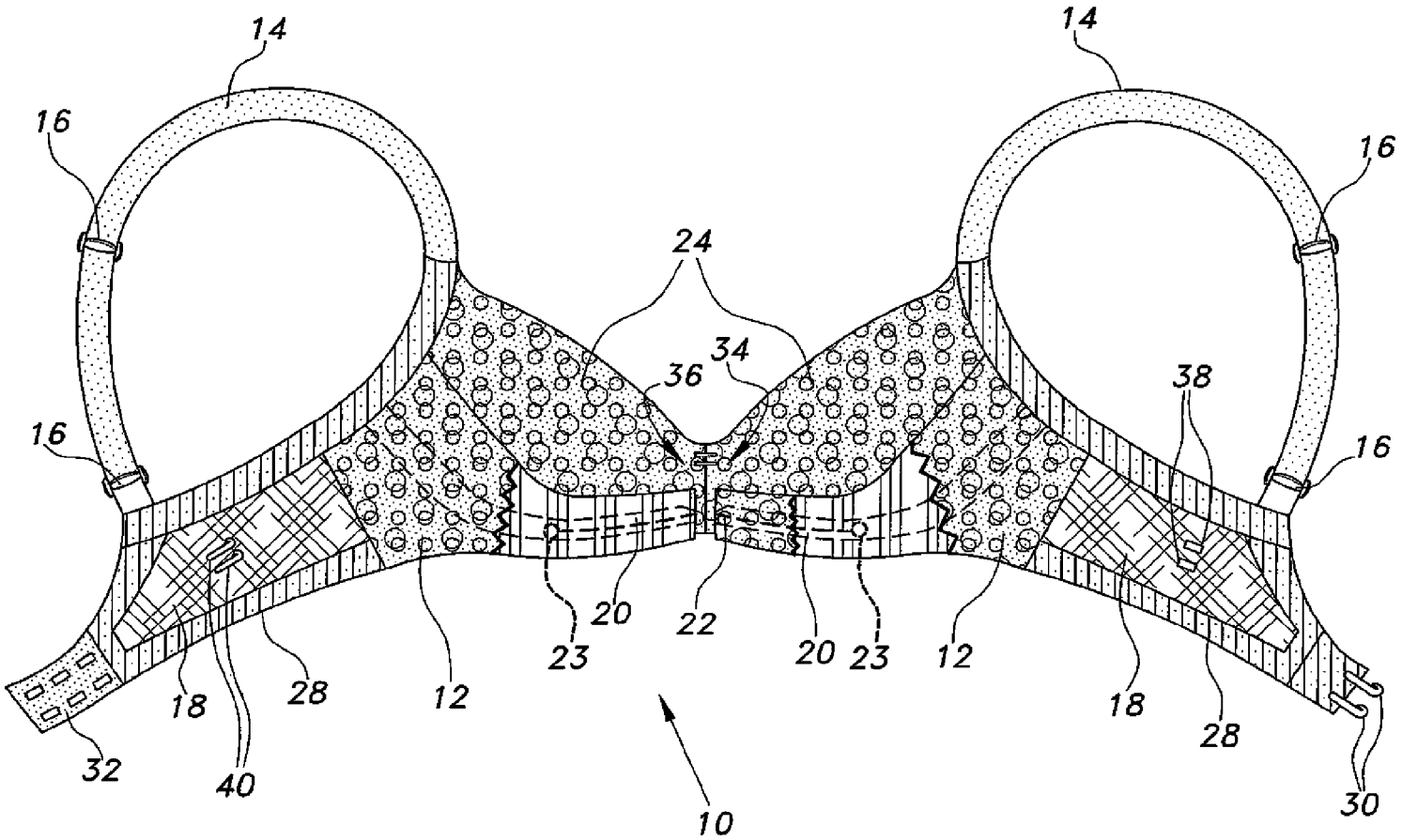
FIG. 3 is a front view of the brassiere with adjustable spacing between cups, illustrating a closed configuration of the fabric cups, the flaps being secured to each other.

In the embodiment of FIGS. 2 and 3, a stop 23 is preferably formed on either end of the wire 21 to prevent the wire 21 from accidentally being fully removed from channels 20. Preferably, the open ends 21 are tapered to prevent the stops 23 from accidentally sliding out of the respective channels. Similarly, in the embodiment of FIG. 4, stops 43 are formed on either end of wire 42.

Further, as best shown in FIG. 2, a pair of fabric flaps 24 are provided for selectively increasing the area of coverage of the brassiere 10 and, as will be described below in detail, enhancing the cleavage between the wearer's breasts. In FIG. 2, for illustrative purposes, one of flaps 24 is shown folded forward, and the other flap 24 is positioned above its corresponding cup 12. This allows the user to wear the brassiere 10 as either a demi cup (or open cup) brassiere (with both flaps 24 being free) or as a conventional brassiere with more coverage for the user's breasts, along with cleavage enhancement, as in the configuration of FIGS. 1 and 3. As will be described in further detail below, when not in use, the flaps 24 may be secured, allowing the brassiere 10 to be used as an open, lingerie-type brassiere.

In use, when the user first puts the brassiere 10 on, the torso band 28 is secured about the user's torso by fastening the hooks 30 and eyes 32. When the wire 22 is fully extended, as in FIG. 2, the brassiere 10 may be worn like a conventional brassiere. For example, if the user wears a conventional size "32" brassiere, then with the wire 22 extended, as in FIG. 2, the size of brassiere 10 would be a matching size "32". The length of each cup, measured circumferentially, is shorter than in a conventional brassiere due to the additional circumferential length being added by the wire 22. The flaps 24 have dimensions to match their mating cups.

As shown in FIG. 3, the user may secure the flaps 24 in place by conventional brassiere hooks 34 and loops 36, respectively, secured to each flap 24, or by any other suitable releasable attachment. In this position, the wire 22 is contained completely within the channels 20, thus decreasing the size of the brassiere 10. Thus, in the position of FIG. 3, not only is the coverage of the wearer's breasts increased, but the brassiere has been tightened to enhance the wearer's cleavage between the breasts and lift the breasts. If the user chooses to not use the flaps 24, the hooks 34 may be secured to eyes 38 on a side panel 18 of the brassiere 10 below the shoulder strap 14, and, similarly, eyes 36 may be secured to hooks 40 on the opposite side panel 18. It should be understood that any suitable type of releasable fastener may be utilized.

The hooks 40 and eyes 38 are secured to the outer faces of the stretchable side panels 18, as shown, which are fabricated from any suitable type of material that is elastic and soft enough to provide comfort for the user, and is also strong enough to provide at least partial support for the user's torso. Preferably, the panels 18, cups 12, flaps 24, and band 28 are formed from materials that are common in the manufacture of brassieres, such as nylon, spandex, combinations thereof, or the like. The panels 18 are preferably formed from a material that is less elastic than the flaps in order to prevent bulges of flesh from being created.

As illustrated in FIG. 1, the flaps 24 not only provide additional coverage for the user's breasts, but are also used to enhance the cleavage of the user by applying inward and upward support force to the user's breasts. The support wire 22 is adjustably slidable within the channels 20, the ends of the support wire 22 being freely slidable within the channels 20, allowing the user to adjust the spacing between the demi cups 12 in order to further enhance the user's cleavage. As shown in FIG. 3, as the flaps 24 are stretched to cover the breasts and are fastened closed, the support wire 22 slides further into the support wire channel 20. It should be understood that the hook and eye fasteners for the torso band 28 and flaps 24 may be replaced by any suitable type of releasable fastener, such as hook and loop fasteners, buttons, lace ties, ribbons and the like. Additionally, the fasteners may be adorned with any desired decorative ornamentation, such as chain, ribbon, lace or the like.

The support wire 22 may be any elongate flexible member formed from metal wire, plastic or the like, as is conventionally known in the manufacture of underwire support brassieres. It should be understood that the overall shape, dimensions and thickness of support wire 22 may be varied, and that support wire 22 may be covered with fabrics or the like, for both comfort and aesthetic purposes. Low friction materials, such as satin or silk, for example, may be used to aid in the sliding of support wire 22 within channels 20. As a further alternative, the support wire 22 may be removed and be replaced by chain, lace, ribbon or any other desired material, depending upon the preference of the wearer. In this embodiment, the open channels 20 would be removed and the chain, lace, etc. would simply hang down, beneath the band 28 when the flaps 24 are secured together.

It should be understood that the brassiere 10 is shown for exemplary purposes only, and may be manufactured in a variety of shapes and styles using any desired fabrics or other materials. The cups 12 and the flaps 24, for example, may be padded or manufactured from decorative materials.

It is to be understood that the present invention is not limited to the embodiments described above, but encompasses any and all embodiments within the scope of the following claims.

I claim:

1. A brassiere with adjustable spacing between cups to enhance a user's cleavage, comprising:

an elastic torso band adapted for releasable mounting about a user's torso;

a pair of fabric cups attached to the elastic band and being opposed to each other in a spaced horizontal alignment, each of the cups having a lower portion and a channel defined in the lower portion of the cup, each of the channels defining an open end, wherein the open ends are opposed to each other; and an elongate connecting member having opposed ends, each of the opposed ends extending through a respective one of the open ends defined in the pair of fabric cups, the connecting member being slidable within the channels so that the pair of fabric cups may be brought together thereby bringing the breasts together over the breast bone to create cleavage.

2. The brassiere with adjustable spacing as recited in claim 1, further comprising a stop mounted on each end of the elongate connecting member to prevent removal of the opposed ends thereof from their respective open ends of the channels.

3. The brassiere with adjustable spacing as recited in claim 2, wherein the elongate connecting member is flexible.

4. The brassiere with adjustable spacing as recited in claim 1, further comprising a pair of flaps, each of said cups having a respective one of the flaps attached thereto, each of the flaps having a free end for selective positioning adjacent a respective open end of each of the channels.

5. The brassiere with adjustable spacing as recited in claim 4, further comprising a central releasable fastener mounted on the flaps for releasably fastening the free ends of the flaps to one another, whereby the flaps may be drawn together and fastened to one another to push the user's breasts together and lift the breasts, thereby forming cleavage, the flaps covering a portion of the breasts otherwise exposed above the cups.

6. The brassiere with adjustable spacing as recited in claim 5, further comprising:

a pair of side panels extending from the torso band; and a pair of side releasable fasteners attached to the side panels for releasably fastening the free ends of the flaps to the respective pair of side panels when the flaps are not in use.

7. The brassiere with adjustable spacing as recited in claim 5, wherein the central releasable fastener comprises at least one hook secured to the free end of one of the flaps and at least one eye secured to the free end of the other one of the flaps.

8. The brassiere with adjustable spacing as recited in claim 1, wherein the elongate connecting member is substantially linear.

9. The brassiere with adjustable spacing as recited in claim 1, wherein the elongate connecting member is a support wire.

10. The brassiere with adjustable spacing as recited in claim 1, further comprising a pair of shoulder straps extending from the torso band, each of the straps being adapted for receiving a respective shoulder of the user.

11. The brassiere with adjustable spacing as recited in claim 1, wherein the connecting member is covered with a material selected from the group consisting of silk and satin.

12. The brassiere with adjustable spacing as recited in claim 9, wherein the support wire is formed of a material selected from the group consisting of plastic and metal.

13. A brassiere with adjustable spacing between cups to enhance a user's cleavage, comprising:

an elastic torso band adapted for releasable mounting about a user's torso;

a pair of shoulder straps extending from the torso band, each of the straps being adapted for receiving a respective shoulder of the user;

a pair of fabric cups attached to the elastic band and being opposed to each other in a spaced horizontal alignment, each of the cups having a lower portion and a channel defined in the lower portion of the cup, each of the channels defining an open end, wherein the open ends are opposed to each other; and an elongate, flexible connecting member having opposed ends, each of the opposed ends extending through a respective one of the open ends defined in the pair of fabric cups, the pair of fabric cups being slidable upon their respective connecting member so that the pair of fabric cups may be selectively adjusted upon the connecting member to a user-selectable spacing, whereby the cups may be drawn toward one another to push the user's breasts together and lift the breasts, thereby enhancing a user's cleavage.

* * * * *